US008303259B2

(12) United States Patent
Kim et al.

(10) Patent No.: US 8,303,259 B2
(45) Date of Patent: Nov. 6, 2012

(54) AXIAL FLOW FAN

(75) Inventors: Jin Baek Kim, Suwon-si (KR); Yi Seok Jeong, Suwon-si (KR); Min Gi Cho, Suwon-si (KR); Jin Yong Mo, Anyang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 599 days.

(21) Appl. No.: 12/458,351

(22) Filed: Jul. 8, 2009

(65) Prior Publication Data

US 2010/0028154 A1 Feb. 4, 2010

(30) Foreign Application Priority Data

Jul. 31, 2008 (KR) ..... 10-2008-0075086

(51) Int. Cl.
*F04D 29/34* (2006.01)

(52) U.S. Cl. ..... 416/213 A; 416/223 R

(58) Field of Classification Search ..... 416/213 R, 416/223 R, 234, 239, 213 A
See application file for complete search history.

(56) References Cited

U.S. PATENT DOCUMENTS

| | | | | |
|---|---|---|---|---|
| 3,711,219 | A * | 1/1973 | Strick | 416/132 R |
| 4,040,769 | A * | 8/1977 | Britz | 416/213 A |
| 4,174,924 | A * | 11/1979 | Smithson, Jr. | 416/132 A |
| 4,893,990 | A * | 1/1990 | Tomohiro et al. | 416/228 |
| 6,010,305 | A * | 1/2000 | Hauser | 416/169 A |
| 6,247,897 | B1 * | 6/2001 | Patel | 416/197 R |
| 6,343,915 | B2 * | 2/2002 | Williams et al. | 416/234 |
| 6,659,724 | B2 * | 12/2003 | Takeuchi et al. | 416/185 |
| 7,959,413 | B2 * | 6/2011 | Ho et al. | 416/234 |
| 8,038,406 | B2 * | 10/2011 | Tanigawa | 416/223 R |

FOREIGN PATENT DOCUMENTS

KR 10-2004-0044643 5/2004

* cited by examiner

*Primary Examiner* — Edward Look
*Assistant Examiner* — Liam McDowell
(74) *Attorney, Agent, or Firm* — Staas & Halsey LLP

(57) ABSTRACT

Disclosed is an axial flow fan capable of preventing cracks from generating at parts where stress is concentrated, by improving the structure. For this, the axial flow fan includes a hub, a plurality of wings extended from an outer surface of the hub, and a reinforcing member filling a space formed between the outer surface of the hub and a front edge part of each wing.

14 Claims, 7 Drawing Sheets

AXIAL FLOW FAN

CROSS-REFERENCE TO RELATED APPLICATIONS

This application claims the benefit of Korean Patent Application No. 2008-0075086, filed on Jul. 31, 2008, in the Korean Intellectual Property Office, the disclosure of which is incorporated herein by reference.

BACKGROUND

1. Field

The present invention relates to an axial flow fan, and more particularly to an axial flow fan capable of distributing rotational stress, by overcoming a problem of the concentration of stress caused during rotation thereof.

2. Description of the Related Art

A fan is a mechanical device used for ventilation or cooling of heat by generating an air current, generally including a centrifugal fan and an axial flow fan. Whereas the centrifugal fan achieves a relatively low volume flow and a high constant pressure, the axial flow fan achieves a relatively high volume flow and a low constant pressure. Accordingly, the axial flow fan is used mainly for cooling.

The axial flow fan is structured to comprise a hub having a substantially cylindrical form, and a plurality of wings extended from the hub in radial directions.

The performance and the noise property of the axial flow fan are determined by a 3-dimensional shape of the wings. Recently, the performance and the noise property of the axial flow fan have been greatly advanced by optimizing the 3D shape of the wings.

Additionally, a safety factor of the axial flow fan may be determined by the mechanical property thereof. More specifically, in a case where the axial flow fan rotates at a high speed or the axial flow fan has been used for a very long time, cracks may generate due to stress concentrated on one certain part. The safety factor is subject to such mechanical property. For example, since a connection part between the hub and the wing has an abruptly changing shape, stress would be concentrated on the connection part, thereby highly increasing the incidence of the cracks. In order to reinforce strength of parts where the cracks are likely to occur, a dedicated member has been attached to the parts.

SUMMARY

Consistent with one aspect of embodiments of the present invention, an exemplary embodiment of the present invention provides an axial flow fan comprising a hub, and a plurality of wings extended from the hub in radial directions and rotated along with the hub, wherein a reinforcing member is formed at an edge part where each of the wings and the hub contact each other, in a rotational direction of the wing.

The reinforcing member may be located at an end of the edge part.

The reinforcing member may be located at a front end of the edge part, with respect to the rotational direction of the wing.

The reinforcing member may be protruded in a thickness direction of the wing.

The reinforcing member may have a spherical shape.

In the axial flow fan, contact parts of the hub and the wings with respect to the reinforcing member may be rounded.

The reinforcing member may be integrally formed with the hub and the wings.

The reinforcing member may comprise a spherical part protruded to an upper part of the wing, and a cylindrical part protruded to a lower part of the wing.

The reinforcing member may include a cavity part depressed in the cylindrical part by a predetermined depth.

Additional aspects and/or advantages will be set forth in part in the description which follows and, in part, will be apparent from the description, or may be learned by practice of the invention.

According to an embodiment of the present invention, there is provided an axial flow fan comprising a hub, a plurality of wings extended from the hub, and a reinforcing member filling a space formed between an outer circumferential surface of the hub and a front edge part of each wing.

Here, contact parts of the hub and the wings with respect to the reinforcing member may be rounded.

The reinforcing member may have a spherical shape.

The front edge part of each wing may be the front, with respect to the rotational direction of the wing, of an edge part formed where each wing contacts the outer circumferential surface of the hub.

The reinforcing member may be welded to the hub and to one of the plurality of wings.

The reinforcing member may be integrally formed with the hub and the wing at once through injection molding.

According to an embodiment of the present invention, there is provided a reinforcing member to reduce a concentration of stress during rotation of a wing attached to a hub of an axial fan, the reinforcing member including a spherical upper part shaped to fit both into the cross section of the wing, and into the circumferential outer surface of the hub, and a lower part shaped to fit into both the cross section of the wing, and the circumferential outer surface of the hub.

The lower part may be spherical, such that the lower part and the spherical upper part form a sphere.

The lower part may be cylindrical.

A cavity part may be formed in the lower part.

Locations where the reinforcing member contacts with either the hub or the wing, may be rounded.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF EMBODIMENTS

Figure 1:
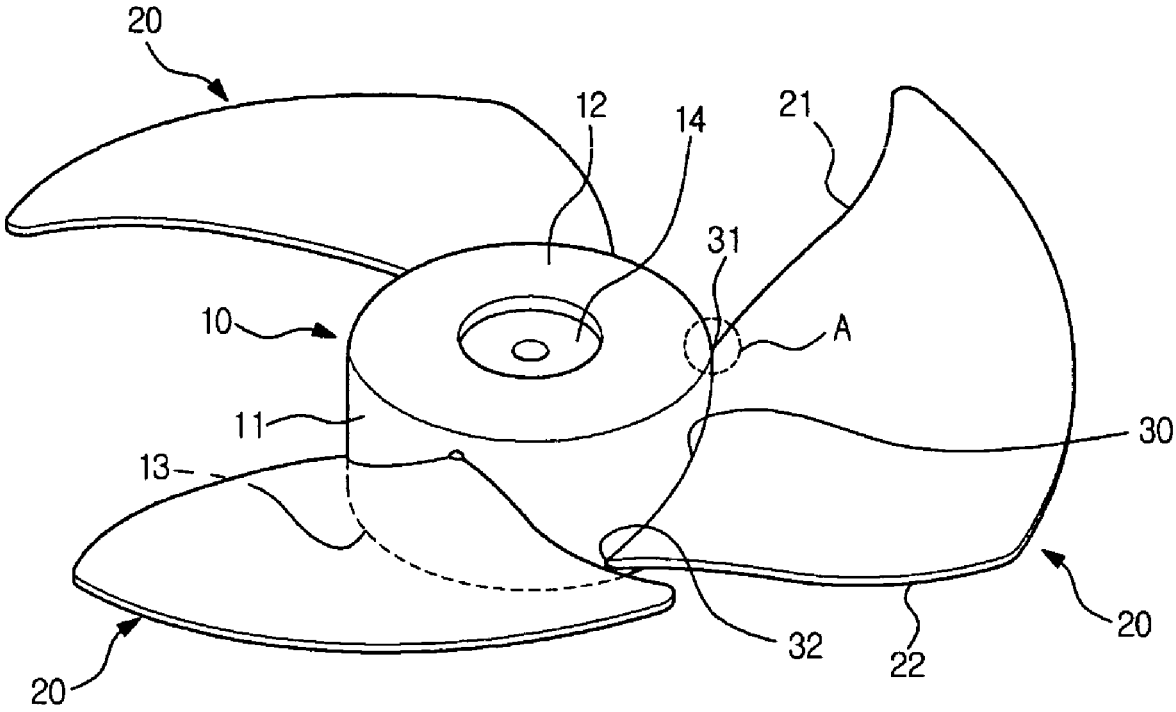
FIG. 1 illustrates the overall view of an axial flow fan according to an embodiment of the present invention.

Reference will now be made in detail to embodiments of the present invention, examples of which are illustrated in the accompanying drawings, wherein like reference numerals refer to like elements throughout. The embodiments are described below to explain the present invention by referring to the figures.

FIG. 1 illustrates the overall view of an axial flow fan according to an embodiment of the present invention.

As shown in FIG. 1, the axial flow fan comprises a hub 10 and a plurality of wings 20 extended from the hub 10 in radial directions.

The hub 10 has a cylindrical shape. A motor fastening part 14 provided in the hub 10 is connected to a motor (not shown) that supplies a driving force for rotating the hub 10. The plurality of wings 20 are arranged along an outer circumference of the hub 10 at uniform intervals. The wings 20 generate an air flow by rotating along with the hub 10.

As shown in FIG. 1, each of the wings 20 has a 3-dimensional shape. The performance and the noise property of the axial flow fan are determined by the 3D shape of the wings 20. Since the plurality of wings 20 may all have the same 3D shape, one out of the plurality of wings 20 will be illustrated and explained.

The wing 20 has a concave curve shape comprising a front edge part 21 disposed at a front side with respect to a rotational direction of the wing 20, and a rear edge part 22 disposed at the opposite side of the front edge part 21. The axial flow fan may also include an edge part 30 formed by contact between the wing 20 and the hub 10. A front end 31 of the edge part 30, corresponding to a front part of the wing 20 with respect to the rotational direction, is disposed near an upper surface 12 of the hub 10. A rear end 32 of the edge part 30 corresponding to a rear part of the wing 20 is disposed near a lower surface 13 of the hub 10. The wing 20 rotates counterclockwise with reference to FIG. 1. An outer part of the front edge part 21 is protruded toward the front with respect to the rotational direction more than the other part, such that a flow noise generated during rotation of the wing 20 can be minimized.

The safety factor of the axial flow fan is determined by the mechanical property of the axial flow fan. Here, the safety factor can be expressed by a yield stress versus an actual stress. The higher the ratio of the yield stress versus the actual stress is, the higher the safety factor is. Therefore, when structuring the axial flow fan, it is preferred that the yield stress is maximized but the actual stress is minimized at a part where the stress is concentrated. Hereinafter, the part on which the stress is concentrated in the axial flow fan and the structure to distribute the stress will be explained.

In the axial flow fan, there is an abrupt change in shape at the edge part 30 between the hub 10 and the wing 20. When the axial flow fan rotates, the stress is concentrated on a part where the shape is abruptly changed, such as the edge part 30. Especially, since the stress is concentrated on the front end 31 of the edge part 30, corresponding to the front part of the wing 20 with respect to the rotational direction, the front end 31 is subject to occurrence of cracks. The reason for the stress concentration especially on the front end 31 in the edge part 30 is because an outer circumferential surface 11 of the hub 10 and the front edge part 21 of the wing 20 forms a v-shape notch. Accordingly, a reinforcing member 40 may be formed at a section A of the front end 31 of the edge part 30 so as make the v-shape notch more fluent, as shown in FIG. 2 to FIG. 7.

Figure 2:
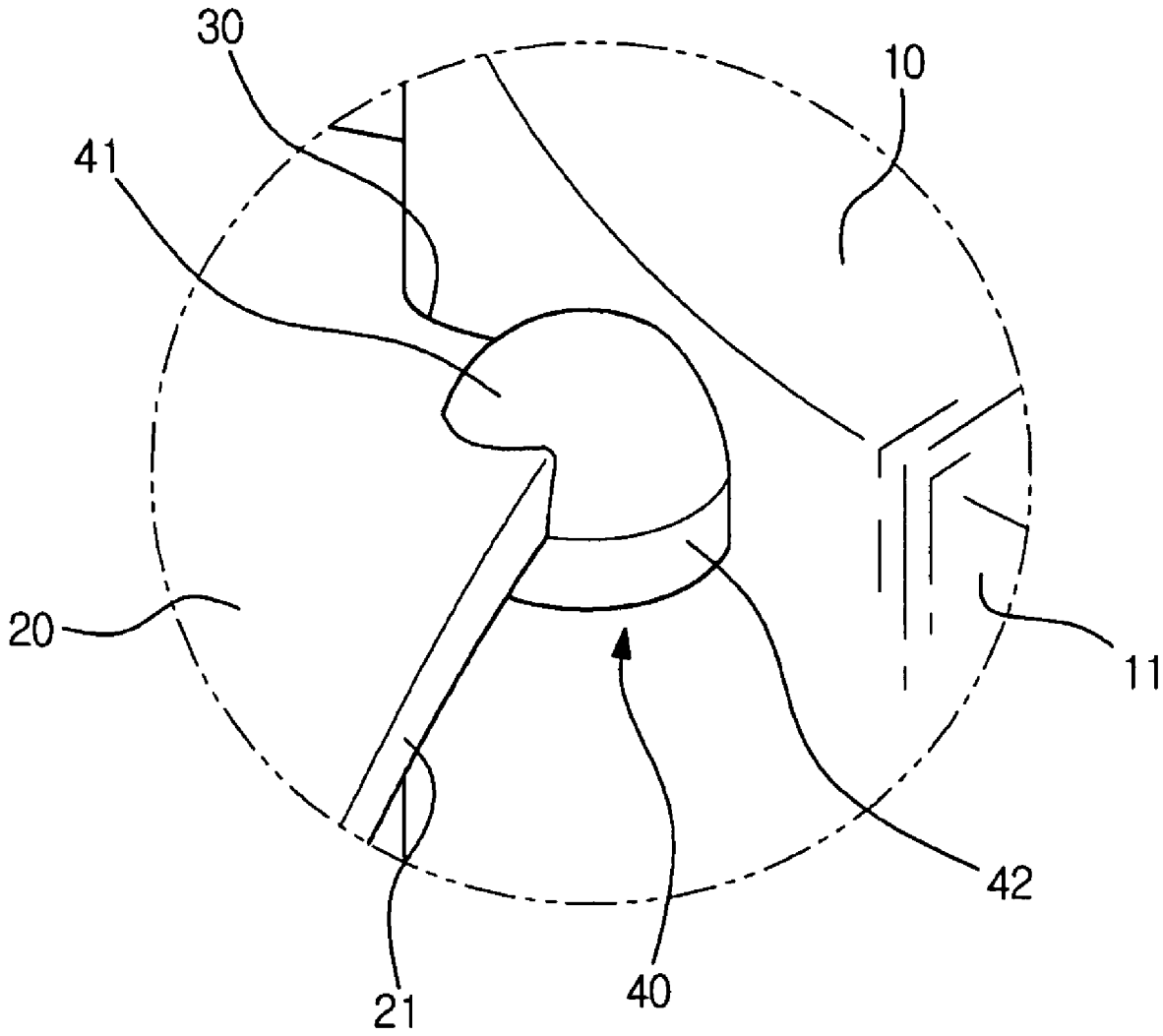
FIG. 2 illustrates an enlarged perspective view of a section A, of FIG. 1 for example.
Figure 3:
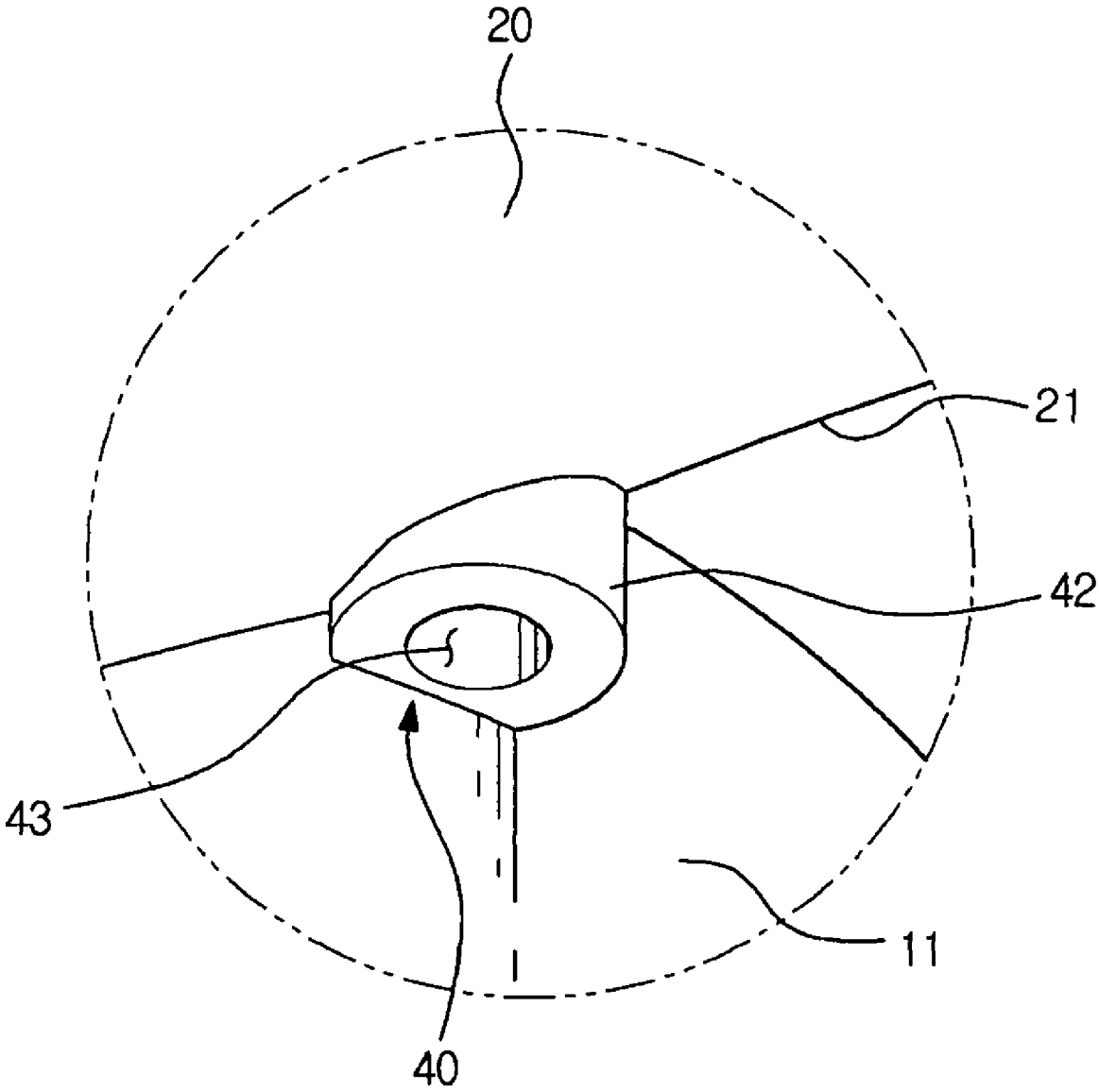
FIG. 3 illustrates an enlarged bottom perspective view of the section A, of FIG. 1 for example.

FIG. 2 illustrates an enlarged view of the section A of FIG. 1, seen from above. FIG. 3 illustrates an enlarged view of the section A, seen from below.

Referring to FIG. 2 and FIG. 3, the reinforcing member 40 fills a space formed between the outer circumferential surface 11 of the hub 10 and the front edge part 21 of the wing 20, by a predetermined degree. The reinforcing member 40 has a spherical shape, more particularly, comprising a spherical part 41 formed at an upper part thereof as shown in FIG. 2 and a cylinder part 42 formed at a lower part thereof as shown in FIG. 3. The reinforcing member 40 is mounted in a thickness direction of the wing 20 so as to increase strength of the wing 20.

More specifically, the reinforcing member 40 is formed at the front end 31 (FIG. 1) of the edge part 30, being partly protruded in the rotational direction of the wing 20. By thus protruding, the reinforcing member 40 can change the v-shape notch formed by the outer circumferential surface 11 of the hub 10 and the front edge part 21 of the wing 20 into an inversed-A shape. That is, the reinforcing member 40 dulls a corner of the notch shape formed between the outer circumferential surface 11 of the hub 10 and the front edge part 21 of the wing 20, by filling the space formed by the outer circumferential surface 11 and the front edge part 21. As a result, the hub 10 and the wing 20 can be connected more gently, thereby restraining concentration of the stress on the front end 31 (FIG. 1) of the edge part 30.

The reinforcing member 40 is in contact with both the hub 10 and the wing 20. When the shape of the contact parts is abruptly changed, stress concentration results. Therefore, the contact parts between the reinforcing member 40 and the hub 10 and between the reinforcing member 40 and the wing 20 may be rounded.

Figure 4:
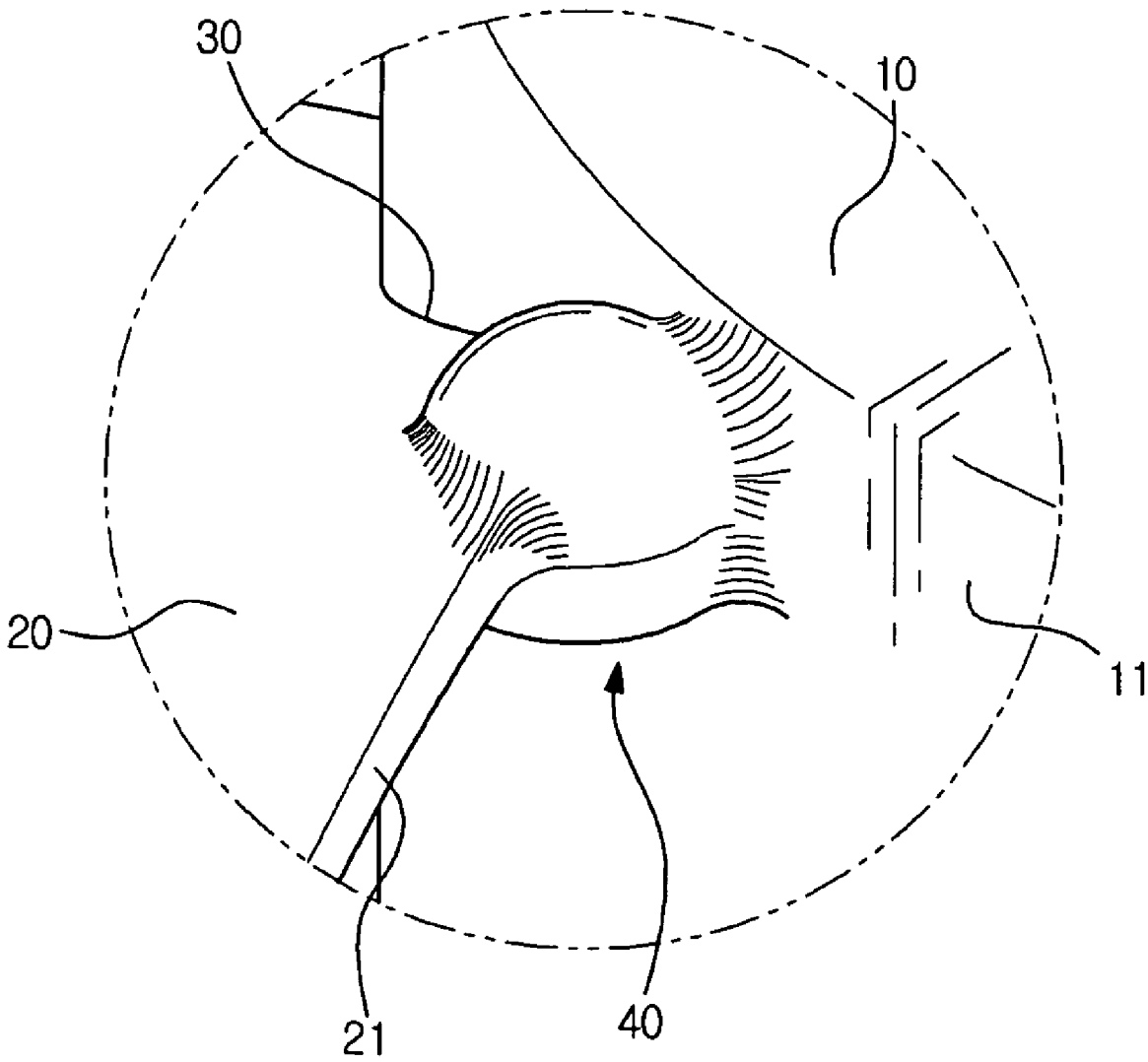
FIG. 4 illustrates a state wherein a part contacting a reinforcing member, for example in FIG. 2, is rounded.
Figure 5:
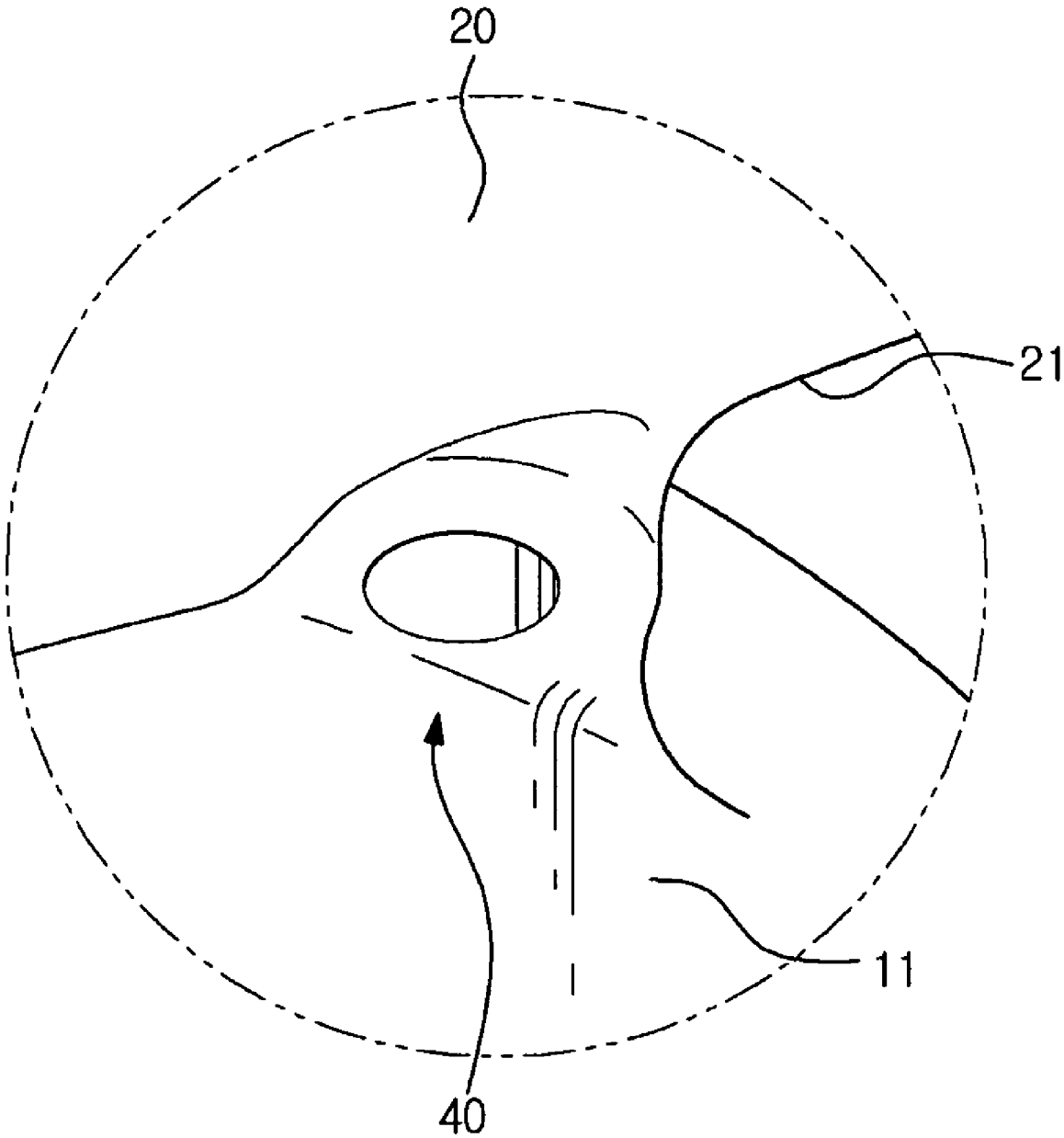
FIG. 5 illustrates a state wherein a part contacting the reinforcing member, for example in FIG. 3 is rounded.

FIG. 4 illustrates the contact parts of the hub 10 and the wing 20 with the reinforcing member 40 shown in FIG. 2, being transformed by rounding. FIG. 5 illustrates the contact parts of the hub 10 and the wing 20 with the reinforcing member 40 shown in FIG. 3, being rounded.

As shown in FIG. 4 and FIG. 5, since all the contact parts with respect to the reinforcing member 40 are rounded, concentration of stress can be prevented.

In terms of the air flow, the reinforcing member 40 does not cause much resistance against the air flow since having a spherical shape. Also, the contact part with the reinforcing member 40 causes a minor resistance since being rounded.

However, the reason of designing the upper part of the reinforcing member 40 in a spherical shape while the lower part in a cylindrical shape as shown in FIG. 2 and FIG. 3 relates to the weight of the axial flow fan. If the reinforcing member 40 has a perfectly spherical shape, the total weight of the axial flow fan is increased as much as the weight of the reinforcing member 40 additionally formed. In this case, power consumption is accordingly increased to drive the axial flow fan. Furthermore, the material cost is increased. In this regard, the weight increase by the reinforcing member 40 needs to be restricted as much as possible. Therefore, the lower part of the reinforcing member 40 is formed into a cylindrical shape, and a cavity part 43 is formed in the lower part. The weight of the reinforcing member 40 can be reduced corresponding to the volume of the cavity part 43 (FIG. 3), being formed in the reinforcing member 40.

Figure 6:
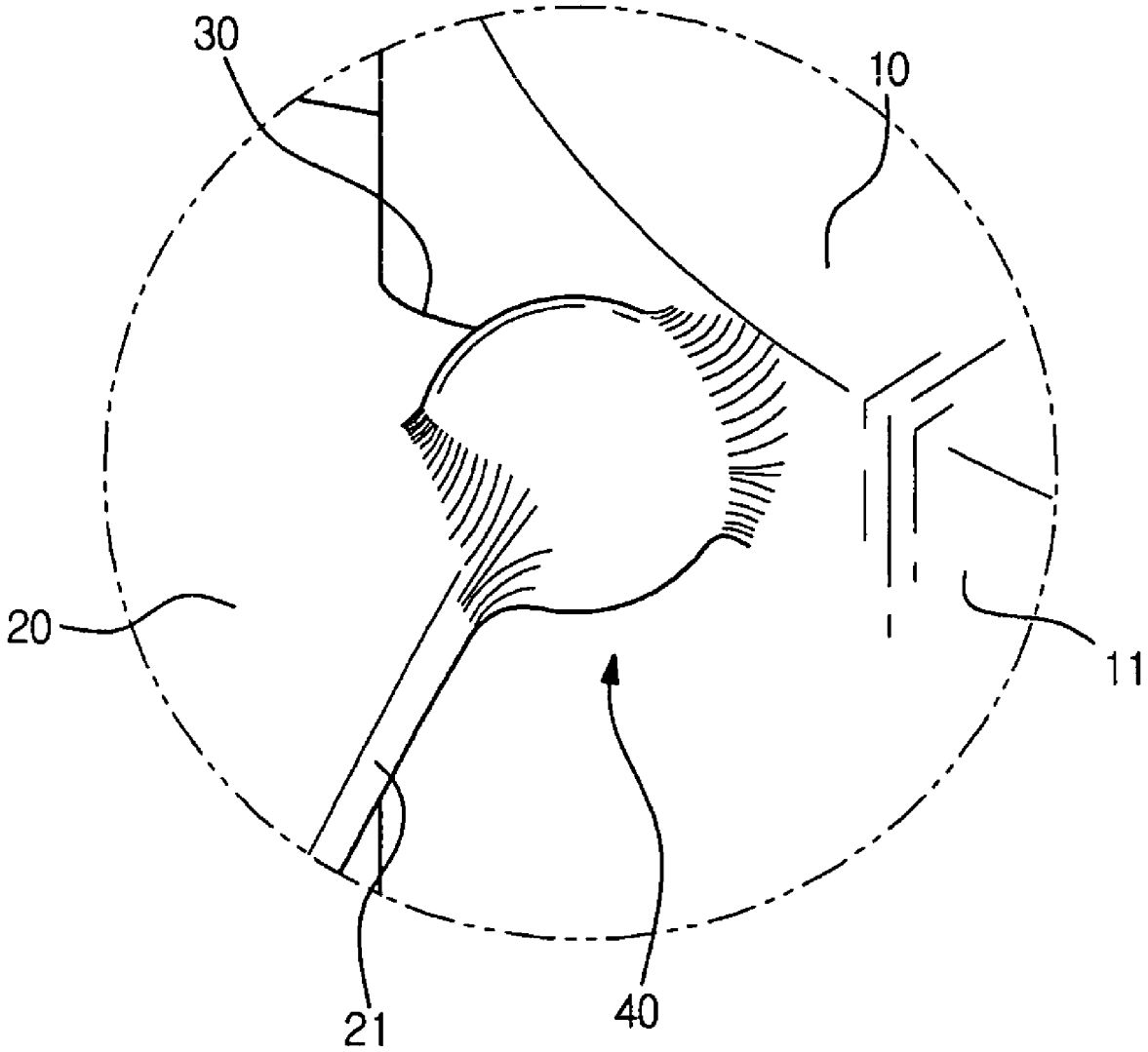
FIG. 6 illustrates an upper part of a reinforcing member of an axial flow fan according to an embodiment of the present invention.
Figure 7:
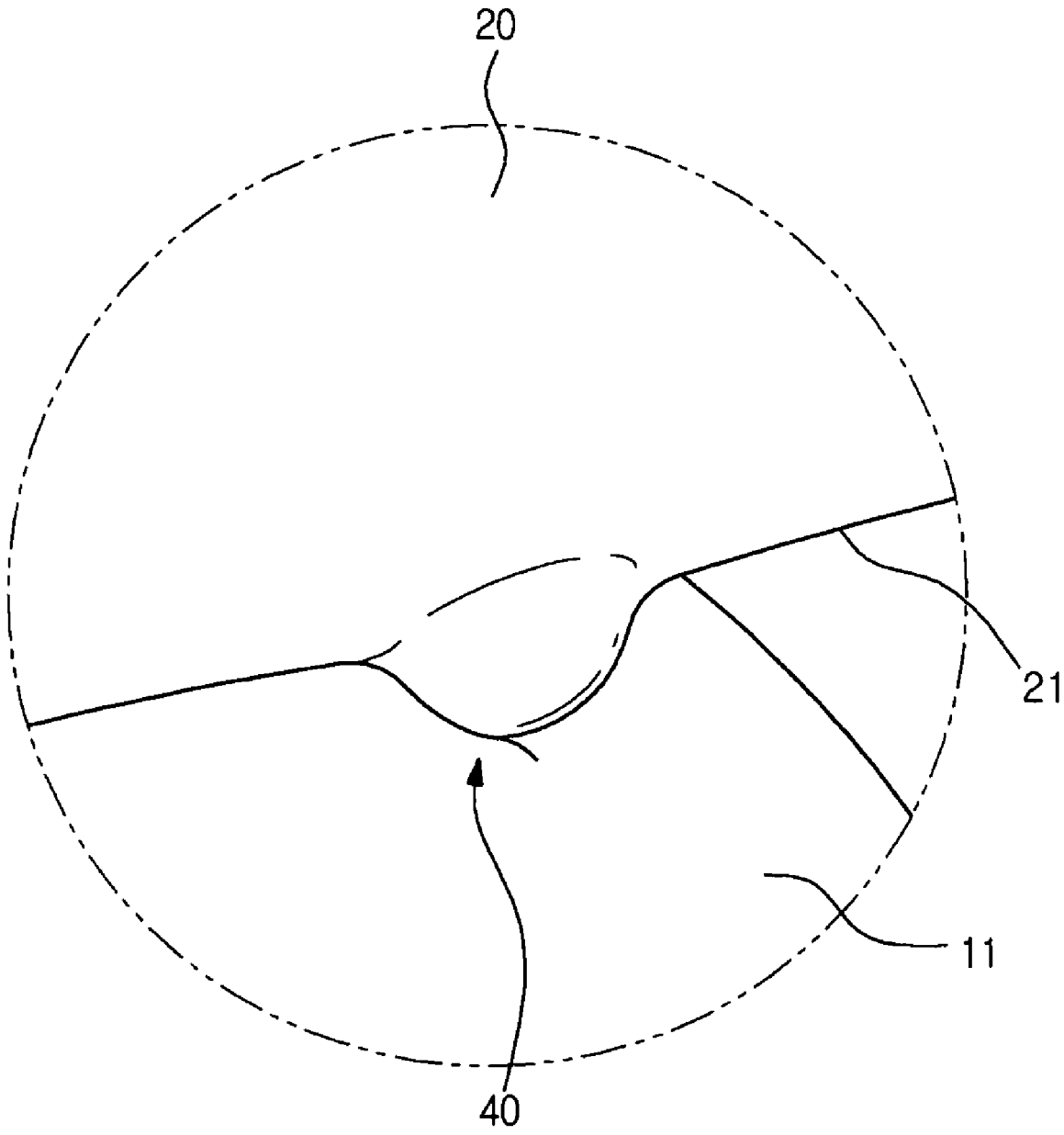
FIG. 7 illustrates a lower part of the reinforcing member of the axial flow fan according to an embodiment of the present invention.

However, since a portion of the reinforcing member 40 with respect to the whole axial flow fan is so minor, the reinforcing member 40 may be formed as a perfect spherical shape as shown in FIG. 6 and FIG. 7, ignoring drawbacks caused by the increase of weight, while the contact parts of the hub 10 and the wing 20 with the reinforcing member 40 are still rounded.

FIG. 6 illustrates an upper part of a reinforcing member according to an embodiment of the present invention, and FIG. 7 illustrates a lower part of the reinforcing member.

Referring to FIGS. 6 and 7, as aforementioned, since the increase of weight by the reinforcing member 40 is ignorable, both the upper and the lower parts of the reinforcing member 40 have a spherical shape. In this case as well, the reinforcing member 40 fills the space formed by the outer circumferential surface 11 and the front edge part 21, thereby preventing concentration of the stress on the front end 31 (FIG. 1), of the edge part 30. In addition to this, contact parts between the reinforcing member 40 and the hub 10 and between the reinforcing member 40 and the wing 20 are rounded so that the stress can be distributed. As a result, concentration of the stress on the section A of FIG. 1 can be prevented, thereby improving the safety factor of the axial flow fan.

Also, since the reinforcing member 40 has a streamline shape, resistance against the air flow is very weak and the air flow can be smoothly generated.

As shown in FIGS. 2 and 3, the reinforcing member 40 can be separately formed and connected to the hub 10 and the wing 20 by welding so that the contact parts are rounded afterward.

Alternatively, the reinforcing member 40 may be integrally formed with the hub 10 and the wing 20 at one time by injection molding. When the axial flow fan is formed by one-time injection molding, the manufacturing process can be simplified. Therefore, work efficiency can be improved while the cost is reduced.

Although embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An axial flow fan comprising:

a hub; and a plurality of wings extended from the hub in radial directions and rotated along with the hub, wherein a reinforcing member is formed at an edge part where each of the wings and the hub contact each other, in a rotational direction of the wing, the reinforcing member comprises: a spherical part protruded to an upper part of the wing; and a cylindrical part protruded to a lower part of the wing, wherein contact parts each of the wings and the hub contacting the reinforcing member are rounded to avoid stress, and wherein the spherical part of the reinforcing member is located at a position where air flows into the axial fan.

2. The axial flow fan according to claim 1, wherein the reinforcing member is located at an end of the edge part.

3. The axial flow fan according to claim 1, wherein the reinforcing member is located at a front end of the edge part, with respect to the rotational direction of the wing.

4. The axial flow fan according to claim 1, wherein the reinforcing member is protruded in a thickness direction of the wing.

5. The axial flow fan according to claim 4, wherein a portion of the spherical part of the reinforcing member is protruded from the hub and each of the wings.

6. The axial flow fan according to claim 1, wherein the reinforcing member is integrally formed with the hub and the wings.

7. An axial flow fan comprising:

a hub;

a plurality of wings extended from the hub; and a reinforcing member filling a space formed between an outer circumferential surface of the hub and a front edge part of each wing, the reinforcing member comprises: a spherical part protruded to an upper part of the wing; and a cylindrical part protruded to a lower part of the wing, wherein contact parts each of the wings and the hub contacting the reinforcing member are rounded to avoid stress, and wherein the spherical part of the reinforcing member is located at a position where air flows into the axial fan.

8. The axial flow fan according to claim 7, wherein a portion of the spherical part of the reinforcing member is protruded from the hub and each of the wings.

9. The axial flow fan according to claim 7, wherein the front edge part of each wing is the front, with respect to the rotational direction of the wing, of an edge part formed where each wing contacts the outer circumferential surface of the hub.

10. The axial flow fan according to claim 7, wherein the reinforcing member is welded to the hub and to one of the plurality of wings.

11. The axial flow fan according to claim 7, wherein the reinforcing member is integrally formed with the hub and the wing at once through injection molding.

12. A reinforcing member to reduce a concentration of stress during rotation of a wing attached to a hub of an axial fan, the reinforcing member comprising:

a spherical upper part shaped to fit both into the cross section of the wing, and into the circumferential outer surface of the hub; and a cylindrical lower part shaped to fit into both the cross section of the wing, and the circumferential outer surface of the hub, wherein contact parts each of the wings and the hub contacting the reinforcing member are rounded to avoid stress, and wherein the spherical upper part is located at a position where air flows into the axial fan.

13. The reinforcing member of claim 12, wherein a portion of the spherical upper part is protruded from the hub and each of the wings.

14. The reinforcing member of claim 12, wherein a cavity part is formed in the lower part.

* * * * *